US008102341B2

(12) United States Patent
Shen

(10) Patent No.: US 8,102,341 B2
(45) Date of Patent: Jan. 24, 2012

(54) DISPLAY SYSTEM AND DRIVING METHOD THEREOF

(75) Inventor: Chang-Han Shen, Hsinchu (TW)

(73) Assignee: Getac Technology Corporation, Hsinchu (TW)

( * ) Notice: Subject to any disclaimer, the term of this patent is extended or adjusted under 35 U.S.C. 154(b) by 579 days.

(21) Appl. No.: 12/337,492

(22) Filed: Dec. 17, 2008

(65) Prior Publication Data

US 2010/0149081 A1 Jun. 17, 2010

(51) Int. Cl.
*G09G 3/36* (2006.01)

(52) U.S. Cl. ..... 345/88; 345/87; 345/77

(58) Field of Classification Search ..... None
See application file for complete search history.

(56) References Cited

U.S. PATENT DOCUMENTS

| | | | | |
|---|---|---|---|---|
| 4,942,388 | A * | 7/1990 | Reitman | 345/690 |
| 5,143,433 | A * | 9/1992 | Farrell | 362/29 |
| 5,170,152 | A * | 12/1992 | Taylor | 345/605 |
| 5,886,681 | A * | 3/1999 | Walsh et al. | 345/102 |
| 6,144,359 | A | 11/2000 | Grave | |
| 6,419,372 | B1 | 7/2002 | Shaw et al. | |
| 6,786,617 | B2 | 9/2004 | Lemay et al. | |
| 6,859,572 | B2 * | 2/2005 | Ishibashi | 385/16 |
| 7,002,546 | B1 | 2/2006 | Stuppi et al. | |
| 7,040,794 | B2 | 5/2006 | Bernard | |
| 7,224,327 | B2 | 5/2007 | Wammes | |
| 2003/0067459 | A1 * | 4/2003 | Lim | 345/207 |
| 2004/0145893 | A1 | 7/2004 | Lemay et al. | |
| 2005/0094391 | A1 | 5/2005 | Campbell et al. | |
| 2006/0187378 | A1 | 8/2006 | Bong et al. | |
| 2007/0139437 | A1 * | 6/2007 | Boroson et al. | 345/590 |
| 2007/0152928 | A1 * | 7/2007 | Doane et al. | 345/87 |
| 2007/0171623 | A1 | 7/2007 | Zagar et al. | |
| 2008/0297451 | A1 * | 12/2008 | Marcu | 345/77 |
| 2009/0027413 | A1 * | 1/2009 | Pyo | 345/589 |
| 2009/0096806 | A1 * | 4/2009 | Inoue et al. | 345/591 |
| 2009/0140974 | A1 * | 6/2009 | Maeda | 345/102 |
| 2009/0225531 | A1 | 9/2009 | Praiswater | |
| 2009/0289962 | A1 * | 11/2009 | Jun et al. | 345/690 |
| 2010/0301758 | A1 | 12/2010 | Chen | |

FOREIGN PATENT DOCUMENTS

DE 10216821 C1 7/2003

* cited by examiner

*Primary Examiner* — Van Chow

(57) ABSTRACT

A display system and driving method thereof are capable of outputting a low luminance of red light, especially through descending a color level of red signals when displayed. The display system includes a display device and an image processing device. The image processing device outputs the red signals to the display device for displaying thereon. The color level of red signals is descended by a display chip or a switch device to allow the display device to display images with low luminance of red light, so that the display device is viewable through a night-vision device.

17 Claims, 6 Drawing Sheets

DISPLAY SYSTEM AND DRIVING METHOD THEREOF

BACKGROUND OF THE INVENTION

1. Field of the Invention

The present invention relates to a display system and driving method thereof, and more particularly, to a display system and driving method that are capable of descending only the output color level of red signals.

2. Related Art

Generally, a user may view directly by eyes the displayed information on a liquid crystal display. In certain special situations, such as military-use, security-monitoring, hunting, observation of a biological environment at night and etc., the brightness of the liquid crystal display has to be descended to avoid affecting the surroundings. Yet the descended brightness is too low for the user to view the liquid crystal display by eyes directly. Therefore the user has to use a night-vision device to read on the information displayed on the liquid crystal display, such as graphs, characters, images and etc. However, for a common night-vision device with the second or third generation of image intensifier, the gains of the visible light in the red and infrared fields are much greater than in other fields of wave bands. As shown in FIG. 1, even the luminance of the liquid crystal display is descended to a very low value, for a common night-vision device not designed for the purpose of viewing on the liquid crystal display, oversaturation still occurs due to an over amplification operation of the night-vision device processed on light signals. Such oversaturation causes damage of the night-vision device and over irritates the user's vision; it makes the user uncomfortable.

Technically, the overall luminance of the liquid crystal display may be descended by reducing the driving current of the liquid crystal display. Yet currently the liquid crystal display is not designed for using under an ultra low luminance. Even with a light emitting diode (LED) that has low driving current applied to the liquid crystal display as a backlight source, the liquid crystal display will then have a minimum driving current limitation since the LED has its minimum driving current limitation. If the driving current of the liquid crystal display is lower than the minimum driving current limitation, flickers of the LED will occur and cause displaying instability on the liquid crystal display. In short, by means of reducing the driving current of the liquid crystal display in the prior art, the liquid crystal display still can not provide a minimum luminance that fulfills a comfortable allowance range of human vision when viewing through a night-vision device, since a minimum luminance of the liquid crystal display is limited by driving circuits or driving components (such as LED).

In the conventional technology, when the minimum luminance of the liquid crystal display does not fulfills the allowance range of the night-vision device or human vision, the night-vision device user places a red-light optical filter sheet on the liquid crystal display, thereby makes the light passing through the red-light optical filter sheet fulfills the allowance range of the night-vision device or human vision. However, such approach has least the following three problems: (1) if liquid crystal display has a touch panel function, the optical filter sheet placed on the liquid crystal display will make the user difficult to apply touch-control operations on the liquid crystal display; (2) the user will need extra efforts to carry and protect the optical filter sheet; and (3) the optical filter sheet is costive for the user since in the market a single piece of 12.1 inch optical filter sheet will cost the user around 1000 U.S. Dollar.

SUMMARY OF THE INVENTION

To solve the aforesaid problems of the prior art, the present invention provides a display system and driving thereof that is capable of outputting low luminance or low color level of certain color light (such as red light), especially by descending the color level of red signal. The display system includes a liquid crystal display and an image processing device; wherein the image processing device outputs red/green/blue signals to the liquid crystal display to display images thereon.

The image processing device descends the color level of the red signal by using a control chip to control a Gamma value of the color level of the red signal. The Gamma value of the color level of the red signal output from the display chip may be modified by software, or modified by employing a color management chip in the signal transmission tunnel. No matter the color management chip is originally equipped for managing the red, green or blue signal, the color management chip will still be able to modify the Gamma value of the color level of the red signal. Such implementation will allow the user to view the display system under special situation. For example, when viewing the display system through a night-vision device, no oversaturation problem will occur on the night-vision device. In a practical implementation, the Gamma value of the color level of the red signal may even be descended to 0.

The way that the image processing device descends the color level of the red signal, may be to configure a switch device between the red signal output of the signal transmission tunnel and the display device. When the user is using the night-vision device to view the display device, a corresponding operation may be performed. For example, by pushing a trigger button to generate a trigger signal, the trigger signal may be used to enable hardware/software to close the transmitting tunnel of the red signal without outputting any red signal.

These and other features, aspects, and advantages of the present invention will become better understood with reference to the following description and appended claims. It is to be understood that both the foregoing general description and the following detailed description are examples, and are intended to provide further explanation of the invention as claimed.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

Figure 1:
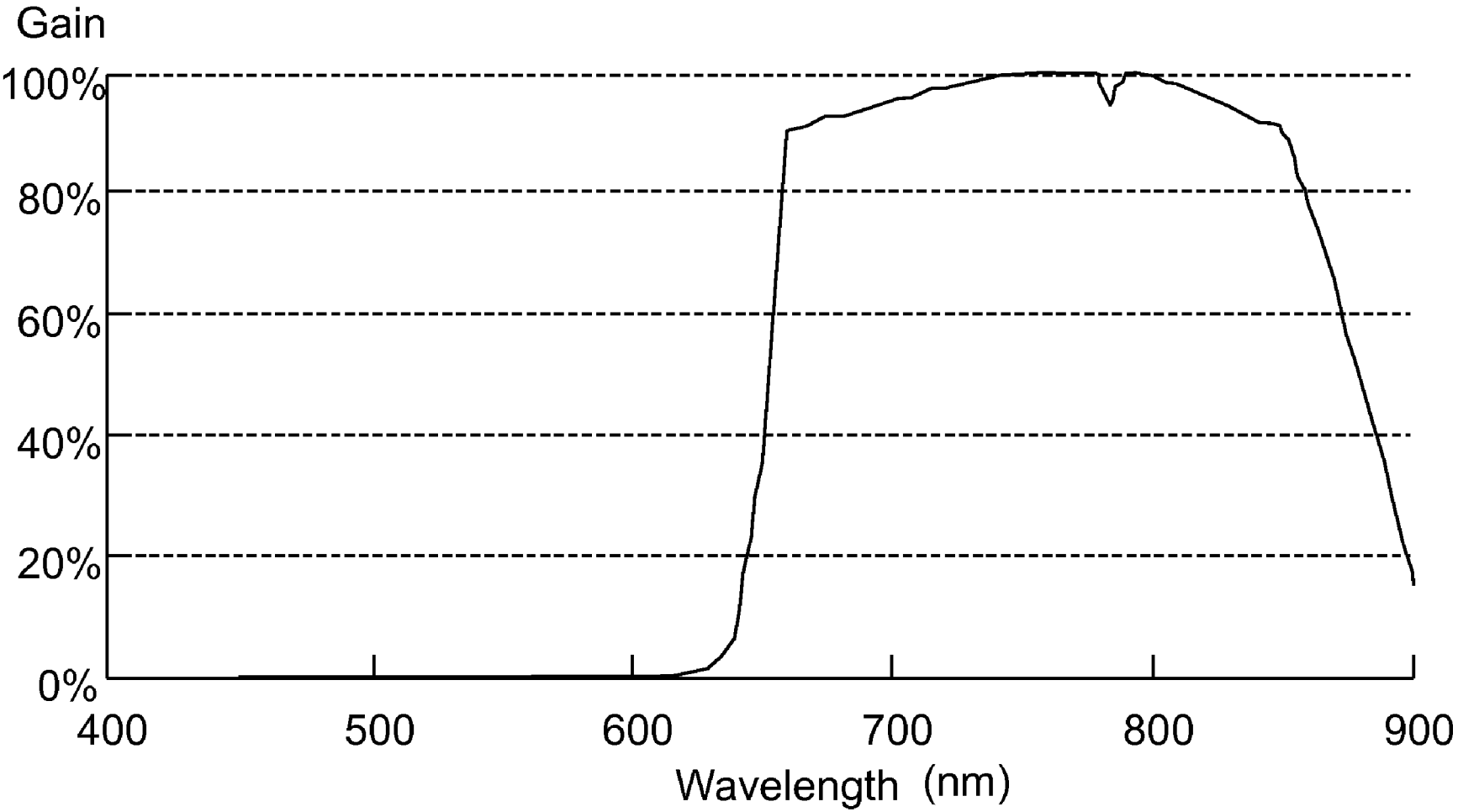
FIG. 1 (PRIOR ART)
FIG. 1 is a gain-wavelength diagram of a night-vision device in the prior art.

Reference will now be made in detail to the present preferred embodiments of the invention, examples of which are illustrated in the accompanying drawings. Wherever possible, the same reference numbers are used in the drawings and the description refers to the same or the like parts.

Figure 2:
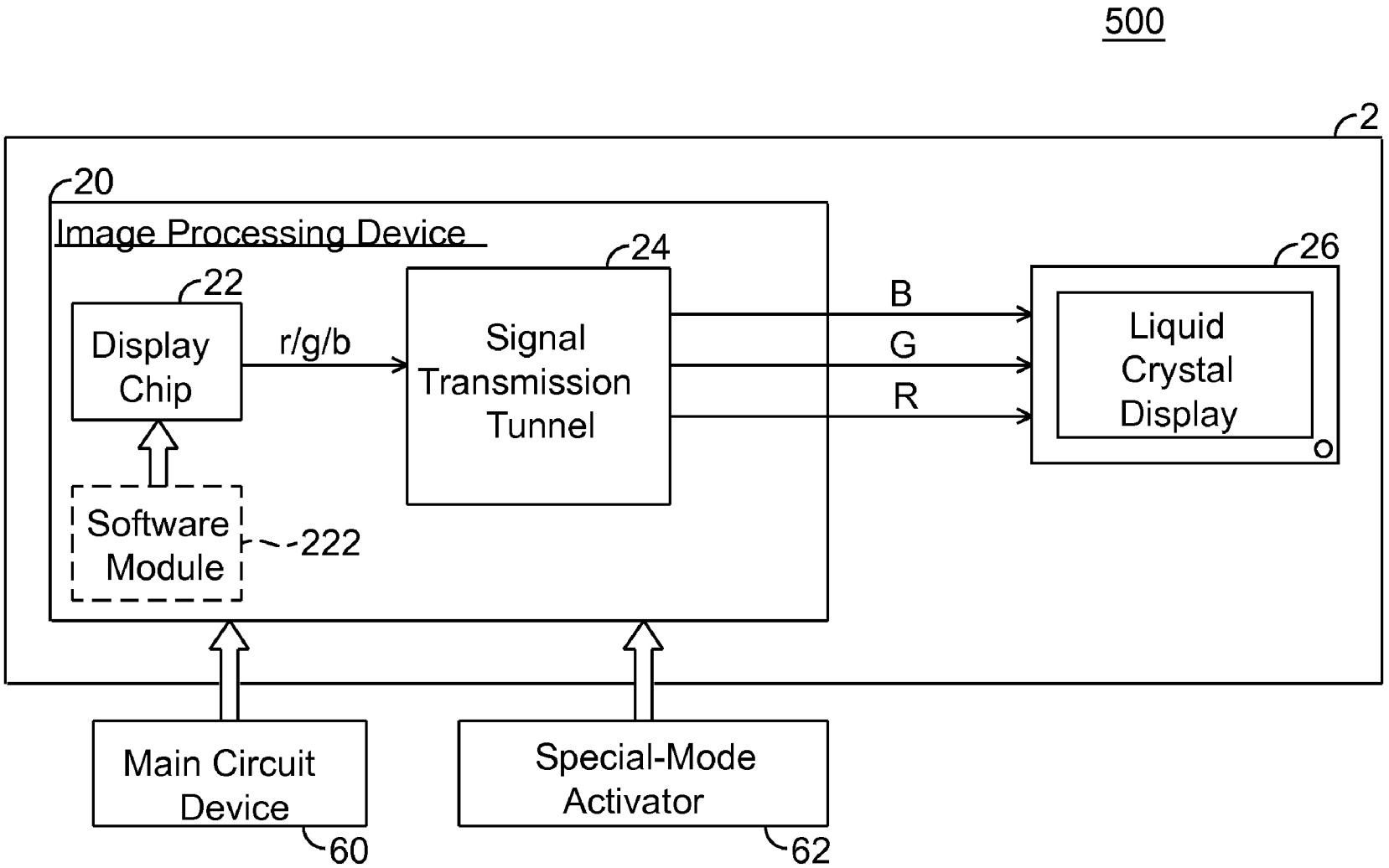
FIG. 2 is a block diagram of a display system according to a first embodiment of the present invention.

FIG. 2 is a block diagram of a display system according to a first embodiment of the present invention. A computer system 500 disclosed in the present embodiment at least includes a display system 2, a main circuit device 60, and a special-mode activator 62. The display system 2 uses a liquid crystal display system as an example, but does not limit the invention thereby. The display system 2 includes a liquid crystal display 26 and an image processing device 20. The liquid crystal display 26 is to display images. The image processing device 20 outputs a Blue signal B, Green signal G and Red signal R to the liquid crystal display 26 for displaying thereon. The image processing device 20 includes a display chip 22 and a signal transmission tunnel 24. The display chip 22 basically receives an image input (not shown), processes the image input for image displaying, and then outputs to the signal transmission tunnel 24. The display chip 22 is capable of performing Gamma correction; the display chip 22 transforms red, blue and green input data (not shown) within the image input into red/blue/green output data r/g/b.

The main circuit device 60, including essential components (such as a CPU (central processing unit), system memory, bridge chipsets and system buses, generally "computer host"; all not shown), deals with the major operation of the computer system 500 (including the operation of an operation system; not shown). Image signals (image input) from the main circuit device that are deemed for display, will be transmitted to the image processing device 20 for processing, and then transmitted as the red/green/blue signals R/G/B to display on the liquid crystal display 26.

Figure 5:
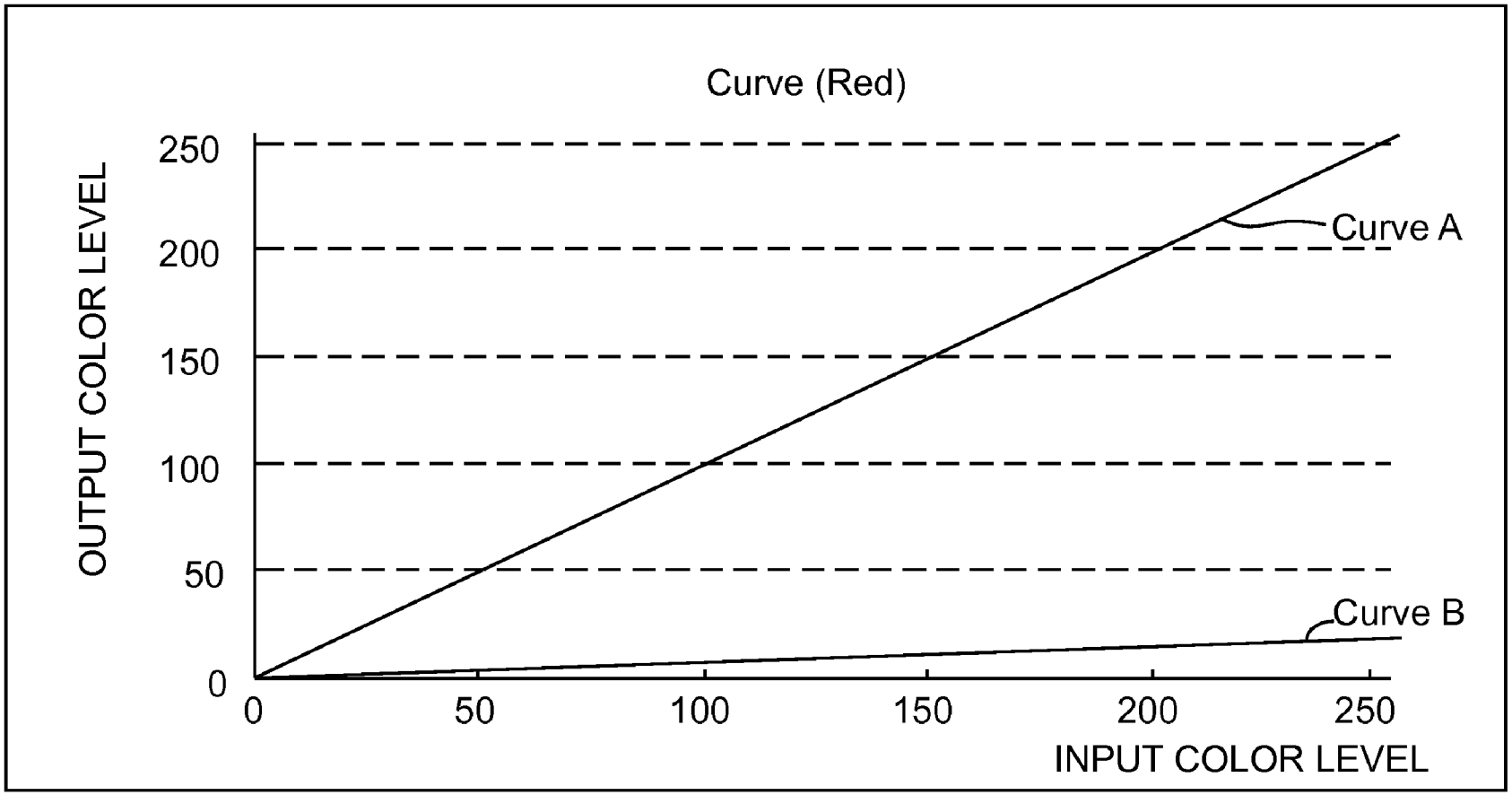
FIG. 5 is a diagram of output-input color levels, showing different curves when a red signal is processed with or without Gamma transformation.

Please refer to FIG. 5, which is a diagram of output-input color levels that shows different curves when a red signal is processed with or without Gamma transformation. For example, the display chip 22 receives red input data (not shown) with the digital color level (or luminance) at a range of level 0~255 (the so called "color level" is a corresponding value when dividing the red color into 0~255 levels with different gradients of deeper/lighter reds). According to Curve A illustrated in FIG. 5, the corresponding relation of the input color level and the output color level is around 1:1. Similarly, blue and green input data (not shown) will follow another similar Gamma curve (not shown) to be processed with corresponding transformation. The image processing device 20 may use a software module 222 (as shown in FIG. 2) to directly control the Gamma transformation within the display chip 22, so as to descend the color level of red data output "r". For example, the color level of the red output data may be descended to zero (0), or descended to a certain ratio as Curve B shown in FIG. 5. The aforesaid software module 222, for example, may be a driver program of the display chip 22.

The blue/green output data b/g and the descended red output "r", will need to pass through the signal transmission tunnel 24 and then become the red/green/blue signals R/G/B for the liquid crystal display 26 to display thereon. Since the red output data is descended, the color level (or luminance) of the red signal is descended accordingly, the red ingredients of the image displayed the liquid crystal display 26 will be descended as well. Such modification is very suitable for a user to view the display under specific situations. For example, when the user views through a night-vision device and watches the displayed information on the liquid crystal display, a corresponding operation may be performed (for example, initiate a specific mode to generate a trigger signal and then use the triggered signal to enable hardware/software to descend the red ingredients and prevent the night-vision device from oversaturated luminance.

The aforesaid specific operation may be realized by the special-mode activator 62. For example, when there is a need to watch the displayed information on the liquid crystal display (26, 36, 46) through the night-vision device, the user may initiate the special-mode activator 62 first (for example, through pressing a specific preset button) to generate the trigger signal. Therefore, the image processing device (20~30) will proceed with said operation of descending the red signal R, so as to fulfill a comfortable allowance range of human vision when viewing through a night-vision device. Namely, what displayed on the liquid crystal display are the normally displayed green/blue signals G/B, and, the red signal R with descended color level.

The signal transmission tunnel 24 of the present embodiment, for example, comprises a transistor-transistor-logic (TTL) or a low voltage differential signaling (LVDS) device, so as to transform the red/green/blue output data r/g/b from the display chip 22, to generate the red/green/blue signals R/G/B and to output to the liquid crystal display 26. The Curves A and B shown in FIG. 5 are both straight lines for explanatory purpose only, yet not as limitations to the present invention. The actual shape of the transformation lines depends on the actual applications. Moreover, the main circuit device 60 and the special-mode activator 62 may be configured inside the display system 2.

Figure 3:
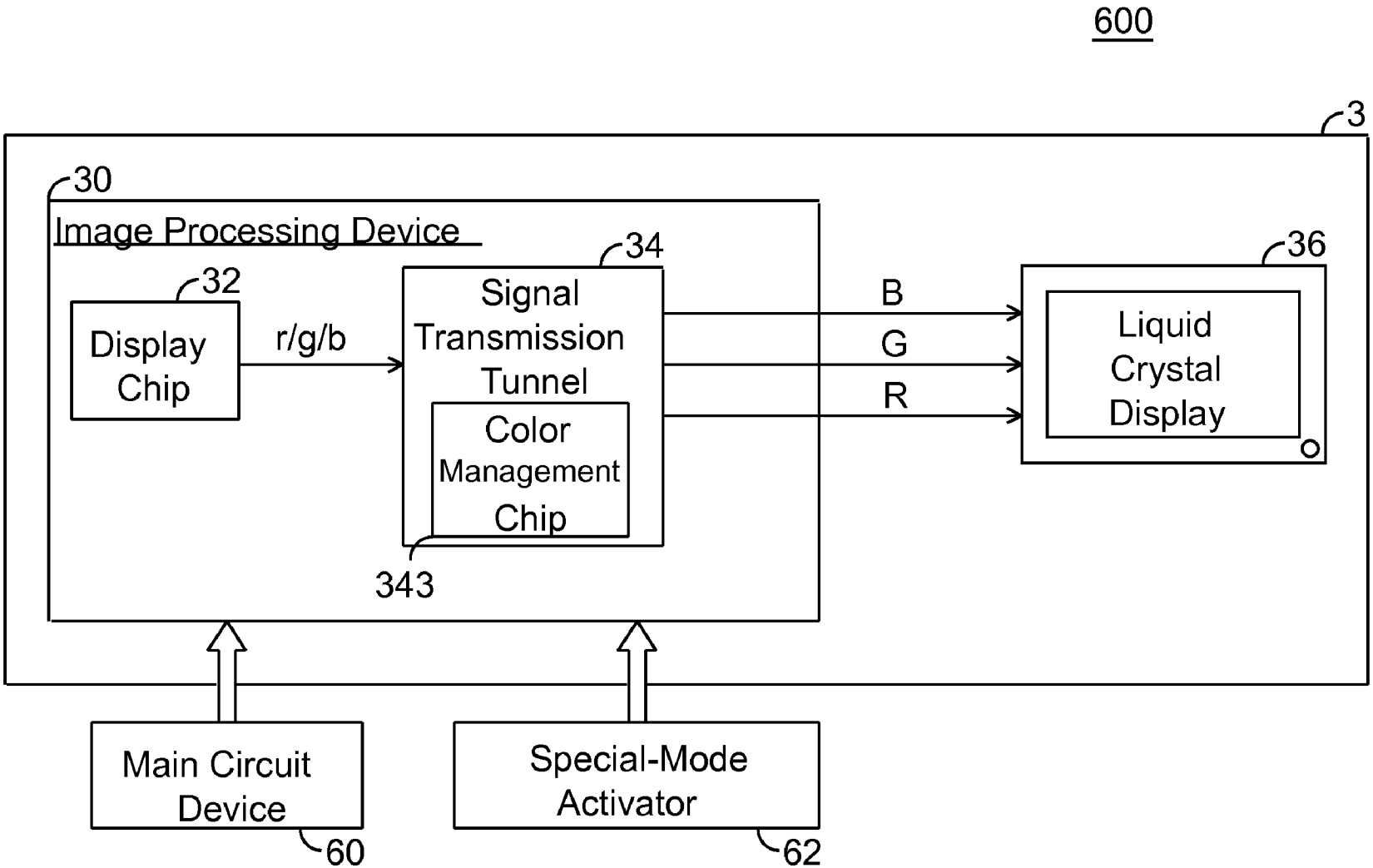
FIG. 3 is a block diagram of a display system according to a second embodiment of the present invention.

FIG. 3 is a block diagram of a display system according to a second embodiment of the present invention. A computer system 600 disclosed in the present embodiment at least includes a display system 3, a main circuit device 60, and a special-mode activator 62. The display system 3 uses a liquid crystal display system as an example, but does not limit the invention thereby. The display system 3 includes a liquid crystal display 36 and an image processing device 30. The image processing device 30 outputs a Blue signal B, Green signal G and Red signal R to the liquid crystal display 36 for display corresponding images thereon. The image processing device 30 includes a display chip 32 and a signal transmission tunnel 34. The display chip 32, basically receives an image input (not shown), processes the image input for image displaying, and then outputs red/blue/green output data r/g/b to the signal transmission tunnel 34.

The main circuit device 60, including essential components (such as a CPU (central processing unit), system memory, bridge chipsets and system buses, generally "computer host"; all not shown), deals with the major operation of the computer system 600 (including the operation of an operation system; not shown). Image signals (image input) from the main circuit device that are deemed for display, will be transmitted to the image processing device 30 for processing, and then transmitted as the red/green/blue signals R/G/B to display on the liquid crystal display 36.

The signal transmission tunnel 34 of the present embodiment, for example, comprises a transistor-transistor-logic (TTL) or a low voltage differential signaling (LVDS) device, so as to transform the red/green/blue output data r/g/b from the display chip 32, to generate the red/green/blue signals R/G/B and to output to the liquid crystal display 36. Most importantly, a color management chip 343 is configured in the signal transmission tunnel 34 to perform the Gamma transformation on the red/blue/green output data r/g/b, thereby collaborating with said TTL, LVDS to generate the red/green/blue signals R/G/B. The color management chip 343 performs the same Gamma transformation as described in the first embodiment and such implementation is not further described herein.

The image processing device 30 uses the color management chip 343 to descends the red output data "r" from the display chip 32, so as to descend the color level of the red signal R. Therefore, the red ingredients of the image displayed the liquid crystal display 36 will be descended as well. Such modification is very suitable for a user to view the display under specific situations. For example, when the user views through a night-vision device and watches the displayed information on the liquid crystal display, no oversaturated luminance will occur on the night-vision device. Similarly, the Gamma transformation of the red signal R, for example, may descend the color level of the red signal to zero (0), or descended to a certain ratio as Curve B shown in FIG. 5. Similarly, the special-mode activator 62 is operated in the same way as in the first embodiment and such implementation is not further described herein. Moreover, the main circuit device 60 and the special-mode activator 62 may also be configured inside the display system 3.

Figure 4:
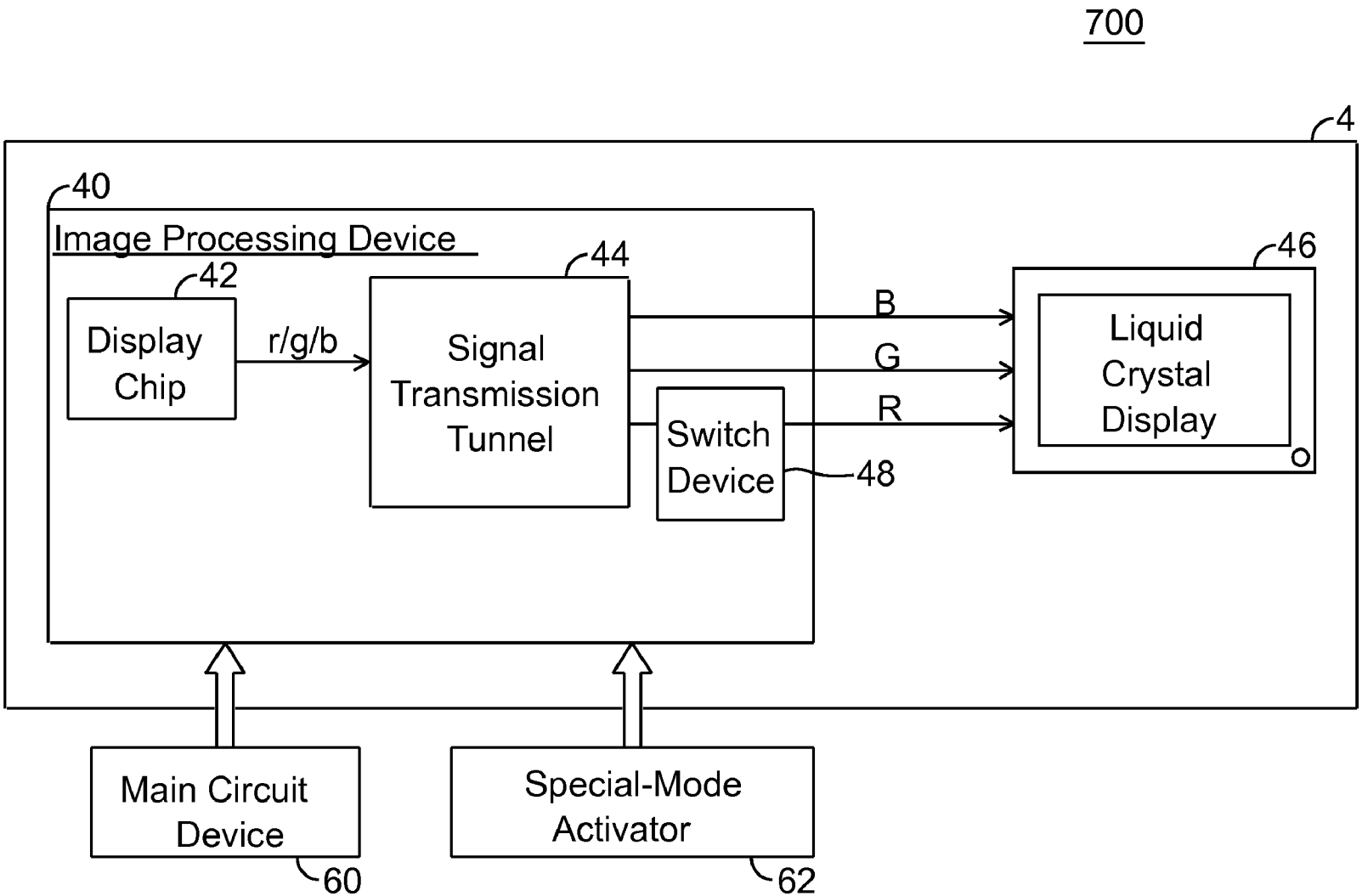
FIG. 4 is a block diagram of a display system according to a third embodiment of the present invention.

FIG. 4 is a block diagram of a display system according to a third embodiment of the present invention. A computer system 700 disclosed in the present embodiment at least includes a display system 4, a main circuit device 60, and a special-mode activator 62. The display system 4 uses a liquid crystal display system as an example, but does not limit the invention thereby. The display system 4 includes a liquid crystal display 46 and an image processing device 40. The image processing device 40 outputs a Blue signal B, Green signal G and Red signal R to the liquid crystal display 46 for display corresponding images thereon. The image processing device 40 includes display chip 42, a signal transmission tunnel 44, and a switch device 48. The display chip 42, basically receives an image input (not shown), processes the image input for image displaying, and then outputs red/blue/green output data r/g/b to the signal transmission tunnel 44. The switch device 48 is electrically connected between the output of the red signal from the signal transmission tunnel and the liquid crystal display.

The main circuit device 60, including essential components (such as a CPU (central processing unit), system memory, bridge chipsets and system buses, generally "computer host"; all not shown), deals with the major operation of the computer system 700 (including the operation of an operation system; not shown). Image signals (image input) from the main circuit device that are deemed for display, will be transmitted to the image processing device 40 for processing, and then transmitted as the red/green/blue signals R/G/B to display on the liquid crystal display 46.

The signal transmission tunnel 44 of the present embodiment, for example, comprises a transistor-transistor-logic (TTL) or a low voltage differential signaling (LVDS) device, so as to transform the red/green/blue output data r/g/b from the display chip 42, to generate the red/green/blue signals R/G/B and to output to the liquid crystal display 46. Most importantly, the red signal R needs to transmit through the switch device 48 first and then transmitted to the liquid crystal display 46. Therefore, when the display system 4 of the present embodiment is operated under a specific situation (for example, the user views through a night-vision device and watches the displayed information displayed on the liquid crystal display), the user may turn off the switch device 48 to cut off the red signal R and make the liquid crystal display 46 fail to receive the red signal R. That means the color level of the cut-off red signal will be equal to the color level of the normal red signal that is descended to zero. Therefore, no oversaturated luminance will occur on the night-vision device. The image processing device 40 may uses a second software module (not shown) or a controller (not shown) to control the operation statuses of the switch device 48. The user may turn off the switch device 48 by operating/initiating the special-mode activator 62. Similarly, the special-mode activator 62 is operated in the same way as in the first embodiment and such implementation is not further described herein. Moreover, the main circuit device 60 and the special-mode activator 62 may also be configured inside the display system 4.

Figure 6:
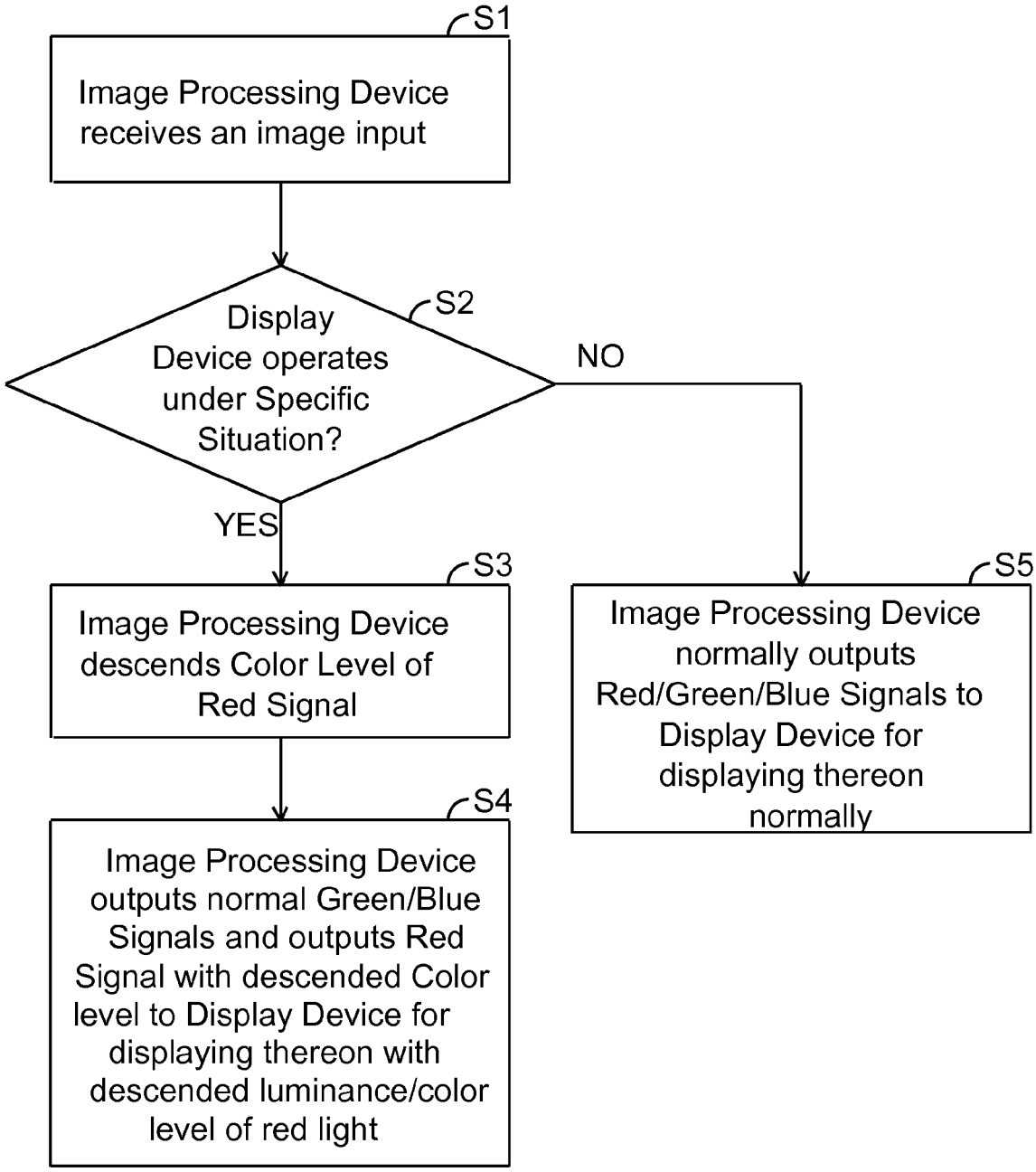
FIG. 6 is a flow chart of a driving method for a display system according to the present invention.

FIG. 6 is a flow chart of a driving method for a display system according to the present invention. Please also refer back to FIGS. 2~4. First of all, the image processing device (20, 30 or 40) receives an image input (Step S1). As mentioned above, if the display system (2, 3 or 4) is to operate under a specific situation, the user will need to initiate the special-mode activator 62; namely, the computer system (500, 600 or 700) in FIGS. 2~4 may use a software module or hardware devices to detect whether currently the display device (26, 36 or 46) is operated under the specific situation (Step S2). If the display device (26, 36 or 46) is operated under a specific situation, the image processing device (20, 30 or 40) will use the foregoing ways to descend the color level of the red signal (Step S3). Afterwards, output the green signal G, the blue signal B and the red signal R with descended color level to the display device (26, 36 or 46) for displaying thereon (Step S4) with descended luminance/color level of red light. If the display device (26, 36 or 46) is operated under a normal or non-specific situation, the image processing device (20, 30 or 40) outputs the green signal G, the blue signal B and the red signal R (not descended) to the display device (26, 36 or 46) for display thereon normally (Step S5).

Additional advantages and modifications will readily occur to those proficient in the relevant fields. The invention in its broader aspects is therefore not limited to the specific details and representative embodiments shown and described herein. Accordingly, various modifications may be made without departing from the spirit or scope of the general inventive concept as defined by the appended claims and their equivalents.

What is claimed is:

1. A display system, comprising:

a display device;

a main circuit device outputting image signals including red, green and blue input data; and an image processing device comprising:

a display chip receiving the image signals from the main circuit device and outputting red, green and blue output data; and;

a signal transmission tunnel, receiving the red, green and blue output data from the display chip and outputting red, green and blue signals to the display device;

wherein the image processing device is configured such that upon receipt of a trigger signal, a color level of the red signal is decreased so that the display device displays with a decreased color level of red light, and wherein only the color level of the red signal is decreased.

2. The display system as claimed in claim 1, wherein the display chip performs Gamma transformation to decrease the color level of the red signal.

3. The display system as claimed in claim 2, wherein the display chip decreases the color level of the red signal to zero (0) upon receipt of the trigger signal by the image processing device.

4. The display system as claimed in claim 2, wherein the display chip decreases the color level of the red signal to a preset ratio upon receipt of the trigger signal by the image processing device.

5. The display system as claimed in claim 2 further comprising a software module to drive the display chip for operation of decreasing the color level of the red signal.

6. The display system as claimed in claim 1, wherein the image processing device comprises:

a switch device, electrically connected between the display device and the output of the red signal from the signal transmission tunnel, configured such that upon receipt of the trigger signal by the image processing device, the switch device cuts off the output of the red signal between the signal transmission tunnel and the display device.

7. The display system as claimed in claim 6 further comprising a second software module or a controller to drive the switch device to cut off the output of the red signal.

8. The display system as claimed in claim 1, wherein the signal transmission tunnel comprising a transistor-transistor-logic (TTL) or a low voltage differential signaling (LVDS).

9. The display system as claimed in claim 1 further comprising a special-mode activator that generates the trigger signal when the special-mode activator is initiated, so that the images displayed on the display device is viewable through a night-vision device without oversaturation of red light.

10. The display system as claimed in claim 1, wherein the signal transmission tunnel comprises a color management chip, configured such that upon receipt of the trigger signal by the image processing device, the color management chip performs Gamma transformation to decrease the color level of the red signal.

11. A method for driving a display system, the display system including a display device, an main circuit device, and a image processing device, the method comprising the steps of:

outputting image signals including red, green and blue input data by the main circuit device;

receiving the image signals by the image processing device;

processing the image signals by the image processing device to generate red, green and blue signals;

outputting red, green and blue signals from the image processing device to the display via a signal transmission tunnel;

on receipt of a trigger signal by the image processing device, decreasing a color level of the red signal, wherein only the color level of the red signal is decreased.

12. The method as claimed in claim 11, wherein the image processing device comprises a display chip that performs Gamma transformation to decrease the color level of the red signal on receipt of the trigger signal by the image processing device.

13. The method as claimed in claim 12, wherein the display chip decreases the color level of the red signal to zero (0) on receipt of the trigger signal by the image processing device.

14. The method as claimed in claim 12, wherein the display chip descends the color level of the red signal to a preset ratio on receipt of the trigger signal by the image processing device.

15. The method as claimed in claim 11, wherein the display system further comprises a switch device electrically connected between the display device and the signal transmission tunnel for the red signal, the switch device cutting off the output for the red signal between the signal transmission tunnel and the display device according to the trigger signal.

16. The method as claimed in claim 11, wherein the trigger signal is generated by a special-mode activator so that the images displayed on the display device is viewable through a night-vision device without oversaturation of red light.

17. The method as claimed in claim 11, wherein the signal transmission tunnel comprises a color management chip, and upon receipt of the trigger signal by the image processing device, the color management chip performs Gamma transformation to decrease the color level of the red signal.

* * * * *